United States Patent [19]

Combs

[11] Patent Number: 4,717,022

[45] Date of Patent: Jan. 5, 1988

[54] OCTAGONAL-SHAPED SHIPPING CONTAINER

[75] Inventor: Kenneth Combs, Warrensville Hts., Ohio

[73] Assignee: General Electric Company, Schenectady, N.Y.

[21] Appl. No.: 882,209

[22] Filed: Jul. 3, 1986

Related U.S. Application Data

[63] Continuation of Ser. No. 685,664, Dec. 24, 1984, abandoned.

[51] Int. Cl.[4] ..... B65D 85/42

[52] U.S. Cl. ..... 206/418; 206/45.14; 206/590; 229/109

[58] Field of Search ..... 206/418, 45.14, 588, 206/590, 592; 229/109, 41 C, 16 D

[56] References Cited

U.S. PATENT DOCUMENTS

| | | | |
|---|---|---|---|
| 3,337,033 | 8/1967 | Cote | 206/45.14 |
| 3,734,397 | 5/1973 | Cote | 229/39 B |
| 4,200,192 | 4/1980 | Klomp | 206/418 |
| 4,236,662 | 12/1980 | Roccaforte | 229/39 B |
| 4,260,059 | 4/1981 | Roccaforte | 206/588 |
| 4,441,650 | 4/1984 | Caldwell et al. | 229/39 B |
| 4,561,542 | 12/1985 | Przepiora et al. | 206/418 |

FOREIGN PATENT DOCUMENTS

| | | | |
|---|---|---|---|
| 272792 | 10/1964 | Australia | 229/39 B |
| 708831 | 5/1965 | Canada | 206/418 |
| 1109192 | 1/1956 | France | 229/39 B |
| 356714 | 10/1961 | Switzerland | 229/39 B |
| 706393 | 3/1954 | United Kingdom | 229/39 B |
| 752385 | 7/1956 | United Kingdom | 229/39 B |
| 861290 | 2/1961 | United Kingdom | 229/39 B |

OTHER PUBLICATIONS

Oberg, Erik et al., *Machinery's Handbook,* Industrial Press, New York, New York, copyright 1964, p. 150.

*Primary Examiner*—Stephen Marcus
*Assistant Examiner*—Bryon Gehman
*Attorney, Agent, or Firm*—Philip L. Schlamp; Nathan D. Herkamp; Edward M. Corcoran

[57] ABSTRACT

A boxboard carton for fragile articles such as a glass electric lamp is shaped so that when the object is within the carton the carton will have an octagonal shape and include intermediate supporting panels to engage one end of the lamp and an end closure construction such that end panels will engage the end of the lamp and inner locking panels will engage the sides of the lamp to form an interference fit between the carton panels and the lamp thereby preventing movement of the lamp relative to the carton.

8 Claims, 5 Drawing Figures

OCTAGONAL-SHAPED SHIPPING CONTAINER

This application is a continuation, of application Ser. No. 685,664, filed 12/24/84, now abandoned.

BACKGROUND OF THE INVENTION

1. Field of the Invention

The present invention relates to shipping containers, and, more particularly, to a container formed of a unitary blank of boxboard having an internal support for the article to be shipped and an end construction for securing the article from contact with objects outside the package.

2. Description of the Prior Art

In order to protect fragile objects, such as electric light bulbs, cardboard cartons housing each such object are used to protect each object individually from impact with the larger carton within which several such packaged objects are packed or impact with other objects during shipping and handling of the object. One prior art approach to packaging such objects is disclosed in U.S. Pat. No. 3,337,033 issued Aug. 22, 1967 to R. A. Cote. The Cote patent describes a four-sided carton in which a pair of platform panels are cut to form a support for the base of a lamp and an end structure including a pair of panels called automatic panels and a pair of bulb engaging panels is used to close the carton. The Cote carton is described as being constructed such that when the automatic panels engage the outer end surface of the bulb, the bulb engaging panels are drawn into contact with the bulb to prevent movement of the lamp to a position flush with the end of the carton walls. The construction of the Cote carton allowed the lamp bulb to move beyond the end of the carton under certain conditions and impact with the container or other surface outside the carton. Construction of the Cote carton also makes it sensitive to humidity conditions for performance in folding to engage and support the lamp bulb and base. Therefore, a need exists for a more secure carton for fragile objects which does not add significantly to the quantity of packaging required.

SUMMARY OF THE INVENTION

An object of the present invention is to provide a carton for a fragile article which securely holds the article when it is placed inside the carton to prevent contact between the fragile article and outside objects. Another object of the present invention is to provide such a secure carton, which uses the minimum amount of packaging material necessary to protect the fragile article.

Accordingly, the present invention comprises a shipping container for a fragile article, such as an electric lamp, formed of a unitary blank of boxboard with its walls scored and shaped such that, when assembled, it forms an octagonal carton having a pair of support panels at an intermediate position along the axial length of the carton and an end portion formed into two pairs of diagonally opposed object engaging end closure panels and two pairs of diagonally opposed locking panels connected together, such that the end closure panels and locking panels provide an interference fit with the surface of the fragile object, so that the object cannot move axially or radially relative to the carton. The carton construction is such that the carton end is self-locking when an object is within the carton but is easily opened by lifting the end panels.

BRIEF DESCRIPTION OF THE DRAWINGS

Further objects and advantages of the present invention together with its organization, method of operation, and best mode contemplated may best be understood by reference to the following description taken in conjunction with the accompanying drawings in which.

DESCRIPTION OF THE PREFERRED EMBODIMENTS

Figure 1:
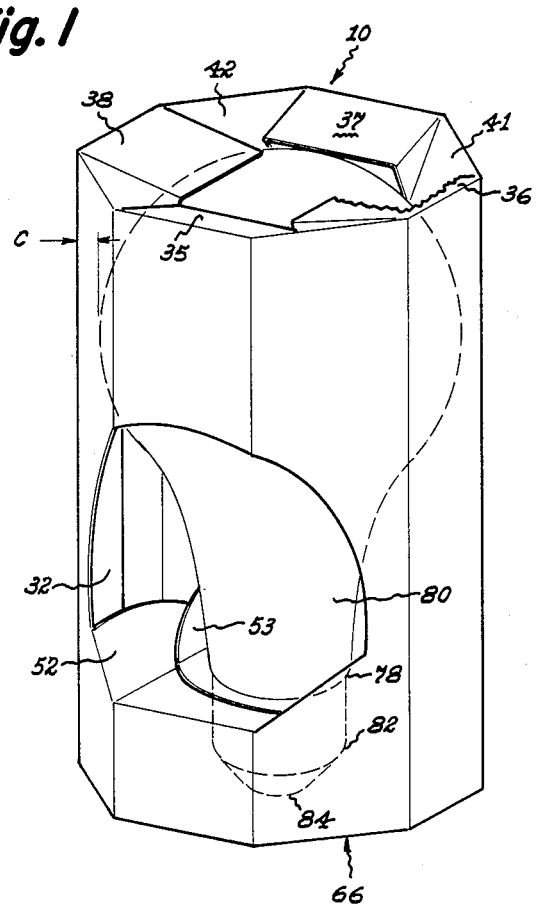
FIG. 1 is a schematic pictorial view illustrating a carton of the present invention.
Figure 2:
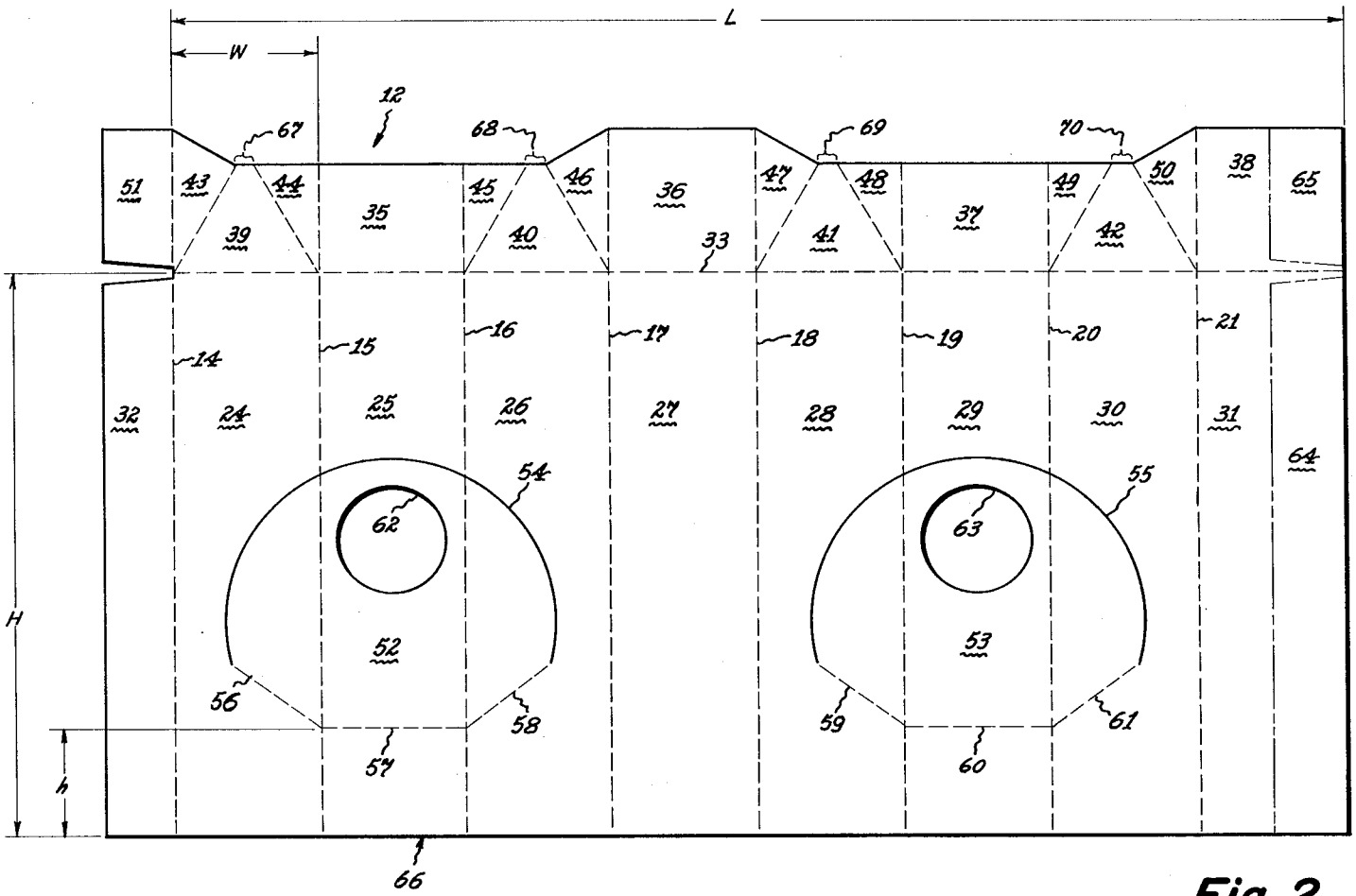
FIG. 2 is a schematic plan view of a boxboard blank from which the carton illustrated in FIG. 1 is constructed.

The carton 10 of the present invention as shown for packaging an electric lamp in FIG. 1 is formed from a generally rectangular boxboard blank 12 shown in the plan view of FIG. 2. The blank 12 is scored vertically as seen in FIG. 2 at lines 14, 15, 16, 17, 18, 19, 20 and 21 to form vertical panels 24, 25, 26, 27, 28, 29, 30 and 31 and a glue flap 32. A horizontal score line 33, which extends the full width of the blank 12, separates the vertical panels 24–31 from the end panels. The terms "horizontal" and "vertical" are used herein for convenience and are not intended as limiting the orientation of the carton. The score lines 15–21 are extended to the end 34 of the blank 12 to form the end panels. Lamp engaging closure panels 35, 36, 37 and 38 are formed as articulated members at the end of panels 25, 27, 29 and 31, respectively. The two closure panels 36 and 38 are longer than the panels 35 and 37 so that the closure panels do not interfere with each other when closed to engage the lamp. Generally trapezoidal locking panel members 39, 40, 41 and 42 are formed as articulated members at the ends of vertical panels 24, 26, 28 and 30, respectively, and are each connected by two triangularly shaped bellows members 43, 44; 45, 46; 47, 48; and 49, 50, respectively, to the adjacent lamp engaging closure panels. The locking panel members 39–42 are shorter than the closure panels 35–38 so that the locking panel members can move to a locking position as described below. The score line 14 is extended vertically to provide a glue flap 51 for securing panel 38 to bellows member 43. Lamp stem support panels 52, 53 are formed by cutting along generally circularly shaped arcs 54, 55 in the panels 24, 25, 26 and 28, 29, 30, respectively, and scoring along score lines 56, 57, 58 and 59, 60, 61, respectively, such that upon assembly of the carton the panels 52, 53 will form diametrically opposite support panels articulated from opposite sides of the carton which overlap such that the cutout 62 in panel 52 will be aligned with a cutout 63 in panel 53 to support the stem of a lamp to be packaged.

The carton 10 is erected as shown in FIG. 1 by gluing glue flaps 32 and 51 to complementary glue surfaces 64, 65, respectively, on vertical panel 31 and closure panel 38 to form a closed tubular container. The erected carton constitutes a generally octagonal package surrounding the lamp 80 by bending the blank along the respective score lines. The lamp stem supporting panels 52 and 53 are folded inwardly at approximately 90 degrees to align the respective stem receiving cutouts 62 and 63, so that the stem 78 of the lamp 80 is secured therein. The height, h, of the portions of the vertical panels 25 and 27 from score lines 57 and 60, respectively, to edge 66 is selected so that the end 84 of the lamp base 82 is kept from contact with a surface of an object flush with the end 66 of the carton 10. The lamp 80 is inserted into the carton, and the end panels are folded to form an interference fit around the generally spherical glass end of the lamp 80. In completing the interference fit of the carton, the trapezoidal locking panels 39, 40, 41 and 42 are folded inwardly through an angle of substantially more than 90 degrees relative to the respective side panels 24, 26, 28 and 30, so that edges 67, 68, 69 and 70, respectively (FIG. 2), engage the generally spherical surface of lamp 80 below the position of engagement of end closure panel members 35–38. This folding causes the bellows panels 43–50 to draw the respective closure panel members 35–38 through an angle of more than 90 degrees but less than the angle of the locking panel members relative to the side panels 25, 27, 29 and 31 and into contact with the end of lamp 80. When the lamp is enclosed within the carton, any force exerted axially upward along the lamp will cause the lamp top surface to engage the closure panels 35–38 and tend to push them upward, which will cause the edges 67–70 of the trapezoidal locking panel members 39–42 to be drawn more tightly into engagement with the lamp surface thereby preventing any upward axial travel of the lamp so that the lamp end cannot reach a position flush with the top edge of the carton. The stem supporting panels 52, 53 are prevented from movement downward beyond an approximately horizontal position by their hinged connection with panels 24, 26 and 28, 30 respectively at the respective score lines. This prevents downward movement of the lamp. The four edges 67–70 are disposed as opposed pairs in engagement with the lamp which prevent radial movement of the lamp. Therefore, the present invention prevents movement of the lamp relative to the carton in any direction.

The height, H, of the boxboard blank 12 is selected based upon the height of the object, such as lamp 80, to be packaged. The length, L, of the boxboard blank 12 is selected based upon the circumference of the object, such as lamp 80, to be packaged, such that a minimum clearance, C, FIG. 1, is provided between the surface of the lamp glass and the interior of the carton, so that no direct contact is made between the sides of the carton and the surface of the packaged object after packaging. In addition to improving the security of the package object, the octagonal shape of the carton of the present invention achieves a reduction in the amount of boxboard required to form the carton for each lamp as compared to a square construction for the same object. For example, enclosing an object such as lamp 80 having a circular cross section with a radius R with a square carton without distortion of the carton requires each of the four side panels of the square carton to have a minimum width of twice the radius, R, of the lamp, so that the total required length of boxboard in the blank would have to be equal to 8R. The size of boxboard blank required to make an octagonal-shaped carton of the present invention can be determined by calculation using the known relationship between width W of each octagonal segment and the radius R of the inscribed circle ( $W=0.828R$) as found in standard handbooks; for example, page 150 of the "Machinery's Handbook" copyrighted in 1964 and published by The Industrial Press of New York, New York. The width, W, of each side is equal to 0.828R, and therefore, the total boxboard length, L, required to surround a circular object having a radius R is equal to eight times 0.828R or 6.624R. Therefore, the present invention provides for a reduction in required boxboard material of 1.376R, an approximately 17.2% savings. It is, of course, recognized that providing for the clearance, C, will affect the total size of blank required, but for the purposes of comparison each shape is measured as just contacting the inscribed circle. The above comparison shows that the present invention provides a carton which securely encloses a fragile object, such as an electric lamp, while requiring a reduced quantity of packaging material as compared to the prior art packaging. The closure of the carton after insertion of the lamp is easily accomplished to securely protect the lamp and also allow ease of opening the carton by lifting one of the end closure panel members.

Figure 3:
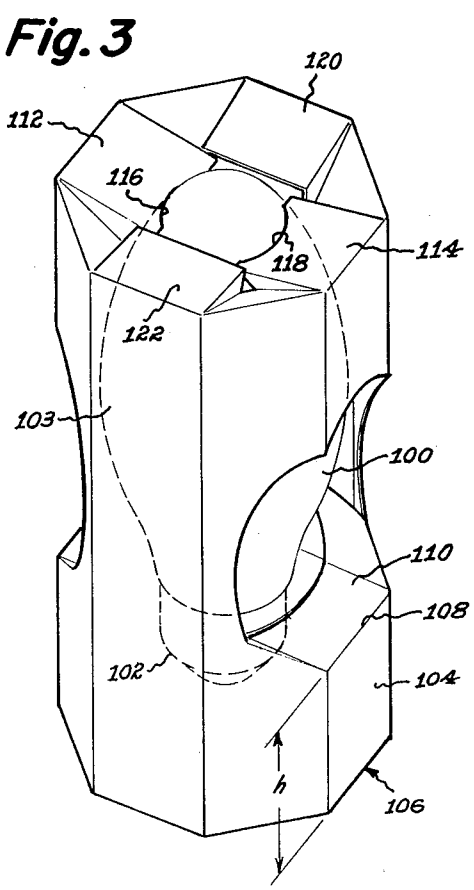
FIGS. 3–5 are schematic diagrams illustrating alternative embodiments of the carton of the present invention.

An alternative embodiment of the carton of the present invention is illustrated schematically in FIG. 3 for a lamp of a different configuration. The lamp 100 illustrated in FIG. 3 is one with a more elongated shape than that shown in FIG. 1 which includes lamps sold by the General Electric Company under the registered trademark Lucalox®. To accommodate this lamp shape which includes an elongated lamp stem 102 and an elongated lamp bulb 103, the height, h, of the boxboard panel 104 between the bottom edge 106 and the score line 108 of the lamp stem support panel 110 is made longer than that shown in the carton of FIG. 1 to prevent contact of the lamp end with an object flush with edge 106. The top end construction is similar to that of the carton 10 except that the end edges are cut such that the opposed top closure panels 112 and 114 have arcuate surfaces 116, 118, respectively, having a radius of curvature approximately equal to the radius of curvature of the exterior surface of the lamp 100 to engage the relatively narrow end of the lamp 100. Also, the closure panels 120, 122 are shortened so that they do not interfere with the movement of the longer closure panels 112, 114 in engagement with the glass wall of lamp 100.

Figure 4:
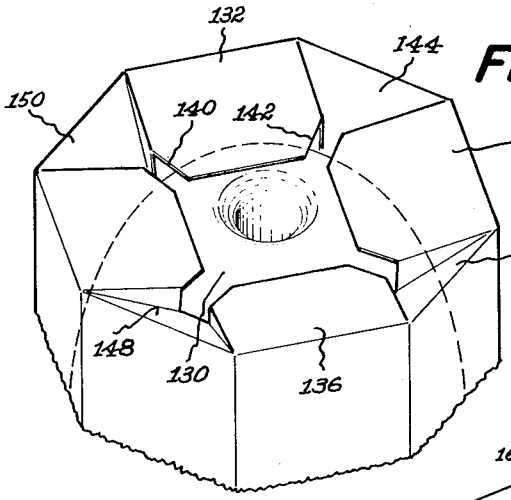

Another embodiment of the present invention is illustrated in FIG. 4 for accommodating another lamp type, e.g. a high intensity, mercury type lamp sold by the General Electric Company under the registered trademark Saf-T-Gard®. The lamp 130 of FIG. 4 has a lamp end shape similar to lamp 100 of FIG. 3 but of substantially larger circular cross section. To accommodate this lamp configuration and enable the top closure panels to engage the surface of the lamp 130 to provide the interference fit necessary to securely hold the lamp, each of the top closure panels 132, 134, 136 and 138 are made long enough to touch the curved surface of the lamp end. In order to avoid interference of one of the closure panels with the adjacent panels, the edges of the respective closure panels are beveled as shown at 140 and 142 of flap 132. The edges of inner locking panels 144, 146, 148 and 150 engage the surface of the glass lamp below the line of the top flaps, so that as the lamp is pushed axially upward in the carton the top closure panels will pull the inner locking panels into more firm engagement with the lamp surface thereby preventing further travel of the top closure panels so that the lamp end cannot reach a position flush with the top edge of the carton.

Figure 5:
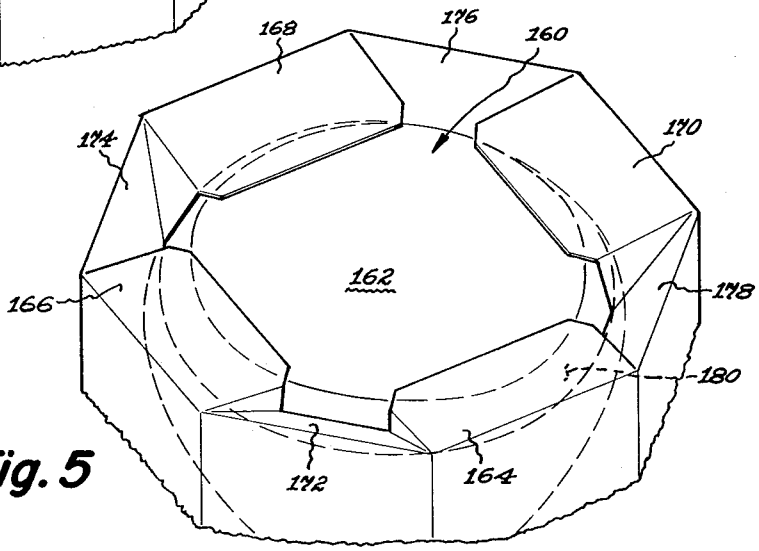

Another alternative embodiment of the carton of the present invention is illustrated schematically in FIG. 5. The lamp 160 of FIG. 5 has a very broad end surface 162 of a very large radius arc compared to the lamps shown in FIGS. 3 and 4 which is typical of certain lamps, for example of the elliptical reflector-type floodlight lamps. The top end of the carton is configured in accordance with the present invention to accommodate this lamp shape and yet provide secure holding of the lamp within the carton. This is accomplished by using shorter ended top closure panels 164, 166, 168 and 170 along with shortened trapezoidal locking members 172, 174, 176 and 178 so configured that the edges of the locking members engage the portion 180 of the lamp having a shorter radius of curvature than end surface 162 and the top closure panels engage the broad lamp end 162 to provide the interference action required to securely hold lamp 160 relative to the carton. In this configuration, as in the others described herein, the top closure panels are in contact with the top surface of the lamp and pull the inner flaps into engagement with the lamp sides to provide an interference fit between the lamp and the closure panels and the locking panels to prevent movement of the lamp beyond a position below the top edge of the lamp carton or in any direction relative to the carton.

As will be appreciated by those skilled in the art, other configurations of the carton of the present invention can be made to accommodate other lamp shapes or other objects to be protected. The present invention provides improved protection while requiring less packaging material, which yields the advantages of fewer products being damaged during handling while reducing the cost of product packaging.

What I claim as new and desire to secure by Letters Patent of the United States is:

1. A self locking carton for a fragile article such as a lamp or electric light bulb which prevents movement of said bulb within said carton comprising:

an octagonally shaped tubular sleeve having a predetermined length having four pairs of side panels disposed diametrically opposite each other comprising artiulated segments of said tubular sleeve:

first and second intermediate support means located at a predetermined position relative to a first end of said tubular sleeve disposed diametrically opposite from each other and each articulated from a plurality of said articulated segments for rigidly supporting said article at an intermediate position along the axial length of said sleeve; and self-locking end closure means comprising a plurality of generally rectangularly shaped end closure panel means articulated from the second end of alternate ones of said side panels and having respective free edges for engaging the end surface of said fragile article at a first predetermined position within said carton relative to said second end of said sleeve, a plurality of generally trapezoidaly shaped article locking panel means articulated from the second end of the remaining alternate ones of said side panels for engaging said article at a second position further from said second end of said tubular sleeve than said first position, and a plurality of triangularly shaped bellows panel means each having a respective one of said end closure panel means attached to and articulated from one edge thereof and a respective one of said article locking panel means attached to and articulated from another edge thereof for connecting a respective one of said end closure panel means to a respective adjacent one of said article locking panel means, wherein said end closure means are folded to form a self locking interference fit around said fragile article and wherein said locking panels extend further axially from said second end of said tubular sleeve than do said end closure panels when said end closure means are folded.

2. The invention of claim 4 wherein:

said free edges of said first pair of end closure panels each comprise an arcuate free edge having a radius of curvature approximately equal to the radius of curvature of the exterior surface of said fragile article.

3. The carton of claim 1 wherein said end closure means comprises:

a first pair of diametrically opposed end closure panels hingedly connected to a first pair of diametrically opposed ones of said side panels and having a first predetermined length; and a second pair of diametrically opposed end closure panels hingedly connected to a second pair of diametrically opposed ones of said side panels disposed a 90 degrees to said first pair of side panels and having a second predetermined length less than said first predetermined length.

4. The invention of claim 5 wherein said end closure means comprises:

a first pair of diametrically opposed end closure panels hingedly connected to a first pair of diametrically opposed ones of said side panels and having a first predetermined length; and a second pair of diametrically opposed end closure panels hingedly connected to a second pair of diametrially opposed one of said side panels disposed at 90 degrees to said first pair of side panels and having a second predetermined length less than said first predetermined length.

5. The invention of claim 1 wherein said first intermediate support means comprises first article support panel means comprising an artiulated panel cut into and hingedly attahed to selected adjacent ones of said side panels and having a hole therethrough for receiving an intermediate portion of said article; and said second intermediate support means comprises second article support panel means comprising an articulated panel cut into and hingedly attached to selected adjacent ones of said side panels disposed diametrically opposite said side panels of said first article support panel means and having a hole therethrough for receiving said intermediate portion of said article such that when said first and second support panel means are folded inwardly said first and second holes are disposed in axial alignment to receive and rigidly support said intermediate portion of said article.

6. The invention of claim 5 wherein:

said free edges of said end closure panel means each comprise an arcuate free edge having a radius of curvature approximately equal to the radius of curvature of the exterior surface of said fragile article.

7. The invention of claim 5 wherein:

the corners of said free edges of respective ones of said end closure panel means comprises beveled corners so that each end closure panel means avoids contact with adjacent end closure panel means when said end closure panel means are in the closed position.

8. The carton of claim 7 wherein said end closure means comprises:

a first pair of diametrically opposed end closure panels hingedly connected to a first pair of diametrically opposed ones of said side panels and having a first predetermined length; and a second pair of diametrically opposed end closure panels hingedly connected to a second pair of diametrically opposed ones of said side panels disposed at 90 degrees to said first pair of side panels and having a second predetermined length less than said first predetermined length.

* * * * *